US005826674A

United States Patent [19]

Taylor

[11] Patent Number: 5,826,674

[45] Date of Patent: Oct. 27, 1998

[54] WHEELED VEHICLE

[76] Inventor: Grant Taylor, 71 Neurum Street, Coolum Beach, Queensland, 4753, Australia

[21] Appl. No.: 633,756

[22] PCT Filed: Oct. 22, 1993

[86] PCT No.: PCT/AU93/00544

§ 371 Date: Jul. 15, 1996

§ 102(e) Date: Jul. 15, 1996

[87] PCT Pub. No.: WO94/09872

PCT Pub. Date: May 11, 1994

[30] Foreign Application Priority Data

Oct. 23, 1992 [AU] Australia ..... PL 5448
Jul. 14, 1993 [AU] Australia ..... PL 9939

[51] Int. Cl.[6] ..... B62D 61/02

[52] U.S. Cl. ..... 180/219; 180/181; 180/223; 280/11.23; 280/442; 280/87.042

[58] Field of Search ..... 180/219, 223, 180/180, 181; 280/11.22, 11.23, 11.24, 442, 444, 87.042, 844, 5.22, 206

[56] References Cited

U.S. PATENT DOCUMENTS

| | | | |
|---|---|---|---|
| 1,771,855 | 7/1930 | MacMillan | 280/11.23 |
| 3,663,031 | 5/1972 | Young . | |
| 3,876,032 | 4/1975 | Ferino . | |
| 4,069,881 | 1/1978 | Shiber | 180/181 |
| 4,132,425 | 1/1979 | Lehner et al. | 280/11.23 |
| 4,274,647 | 6/1981 | Drake, Jr. | 180/181 |
| 4,363,493 | 12/1982 | Veneklasen . | |
| 4,508,187 | 4/1985 | Wenzel . | |
| 5,372,383 | 12/1994 | Kubierschky | 280/11.23 |
| 5,505,474 | 4/1996 | Yeh | 280/87.042 |

FOREIGN PATENT DOCUMENTS

| | | |
|---|---|---|
| 573225 | 6/1924 | France . |
| 615225 | 12/1926 | France . |
| 753203 | 10/1933 | France . |
| 812803 | 5/1937 | France . |
| 932124 | 3/1948 | France . |
| 1234839 | 10/1960 | France . |
| 365513 | 12/1922 | Germany . |
| 386984 | 12/1923 | Germany . |

*Primary Examiner*—Daniel G. DePumpo
*Attorney, Agent, or Firm*—Knobbe, Martens, Olson & Bear, LLP

[57] ABSTRACT

A wheeled vehicle (200) for carrying a person comprising a frame (218, 220, 222, 250) rotatably supporting two substantially in-line wheels (204, 206), and foot support means (254, 256) for, in use, supporting the feet of a user. The wheels are ring-shaped, and the foot support means are in the form of spaced platform structures coupled to the frame and which extend axially through respective said wheels. In order to allow the foot platforms to extend through the central portion of the ring shaped wheels whilst allowing the wheels to rotate, the wheels are rotatably supported on the frame by a plurality of rollers (210) mounted on the frame and arranged around the wheels to bear on circumferential surfaces thereof (208). A motor (236) may also be included to drive one of the wheels under control of the user who is able to operate a hand held throttle control (239).

19 Claims, 7 Drawing Sheets

WHEELED VEHICLE

FIELD OF THE INVENTION

The invention concerns a wheeled vehicle.

Wheeled vehicles such as motorized skates, which may be typically used for recreation, are described, for example, in FR 26 25 688 A1 and DE 32 05 379 A1. The vehicles shown therein comprise a board having two in-line arranged wheels which are rotatably mounted beneath the board or in an opening in the board. The person using the skate (board) stands free-handed on the board and steers the same by weight shifting. A disadvantage of these designs is that they have small sized wheels which in conjunction with the bearing arrangement of the wheels in respect to the board make it very difficult or impossible to use the motorized skate boards on rough terrain.

BACKGROUND OF THE INVENTION

In accordance with the present invention there is provided a wheeled vehicle for carrying a person comprising a frame rotatably supporting two substantially in-line wheels, and foot support means for, in use, supporting the feet of a user, wherein said wheels are ring-shaped and the foot support means comprises spaced platform structures coupled to said frame and which extend axially through respective said wheels.

SUMMARY OF THE INVENTION

The invention also provides a wheeled vehicle for carrying a person comprising a frame rotatably supporting at least one wheel, wherein said at least one wheel is ring-shaped and rotatably supported on said frame by a plurality of rollers mounted on said frame and which are arranged around the at least one ring-shaped wheel to bear upon a circumferential surface thereof.

Preferably the vehicle is provided with two substantially in-line wheels having the foot support means in the form of platforms extending axially through the central portion of respective wheels. Preferably the platforms are positioned so as to be below the axis of rotation of the wheels so as to enable the axis of rotation of the wheels so as to enable the vehicle to, in use, have a lower center of gravity. An engine may also be provided on the frame between the two wheels and coupled to rotatably drive the rear wheel of the vehicle. To allow the user to control the engine a hand throttle can be provided which is operable whilst standing on the foot platforms, and may be coupled to regulate the engine by way of a flexible control line. The front wheel may also be pivotally articulated with respect to the frame and rear wheel to allow for easier steering of the vehicle.

The invention further provides a motorized vehicle comprising:

- a frame to which a drive engine is mounted;
- at least one wheel rotatably supported by said frame;
- transmission means for passing drive torque from said drive engine to a said wheel;
- foot support means onto which a person can step and stand on during movement of the vehicle; and
- control means operable by a person standing on the foot support means to regulate the drive engine;
- characterised in that said wheels are ring-shaped, each being rotatably supported by at least three supporting rollers at different angular positions which engage with an inner circumferential surface of each said ring wheel, bearing axles of said supporting rollers being fixed to said frame, and in that said foot support means comprises two foot platforms each of which extends axially through a respective one of said ring-shaped wheels.

Preferably three of said rollers are disposed symmetrically around the or each said wheel to bear upon the inner circumferential surface thereof, although in one embodiment four rollers are provided with the upper surfaces of the respective foot platforms substantially in a common horizontal plane with two of the support rollers of the respective ring wheel, with the other two rollers of each wheel being positioned directly above and below the foot platforms respectively.

Preferably, also, there are two said wheels arranged substantially in-line with the drive engine mounted on the frame therebetween, and wherein the frame is articulated into two portions with one of said wheels on each portion.

Alternatively, one wheel only may be provided or a plurality of wheels rotatable about the same axis may be provided. In these cases a ski, slide plate, skid or similar non-rotational support member may also be provided, substantially in-line with the one wheel or the plurality of wheels.

The motorized vehicle according to some embodiments of the invention allows operation in rough terrain due to the suspension or bearing of the ring-shaped wheels by their respective supporting rollers on the frame and therefore low center of gravity suspension of the individual foot platforms extending through the ring-shaped front and rear wheels.

The invention further provides a steering mechanism for coupling a wheel to a vehicle, comprising a first pivotal connection between the vehicle and structure rotatably supporting the wheel, and a linkage member comprising a second pivotal connection between the vehicle and the linkage member and a third pivotal connection between the linkage member and said structure, the second and third pivotal connections being spaced from one another along a direction of travel of the vehicle in use, wherein, with respect to the rotational axis of the wheel, the second and third pivotal connections are opposed to the first pivotal connection, such that the wheel is pivotal with respect to the vehicle with a pivot axis which is variable between axes passing through the first pivotal connection and the second and third pivotal connections respectively.

The invention is described in greater detail hereinafter, by way of example only, with reference to the accompanying drawings, wherein:

DETAILED DESCRIPTION OF THE INVENTION

Figure 1:
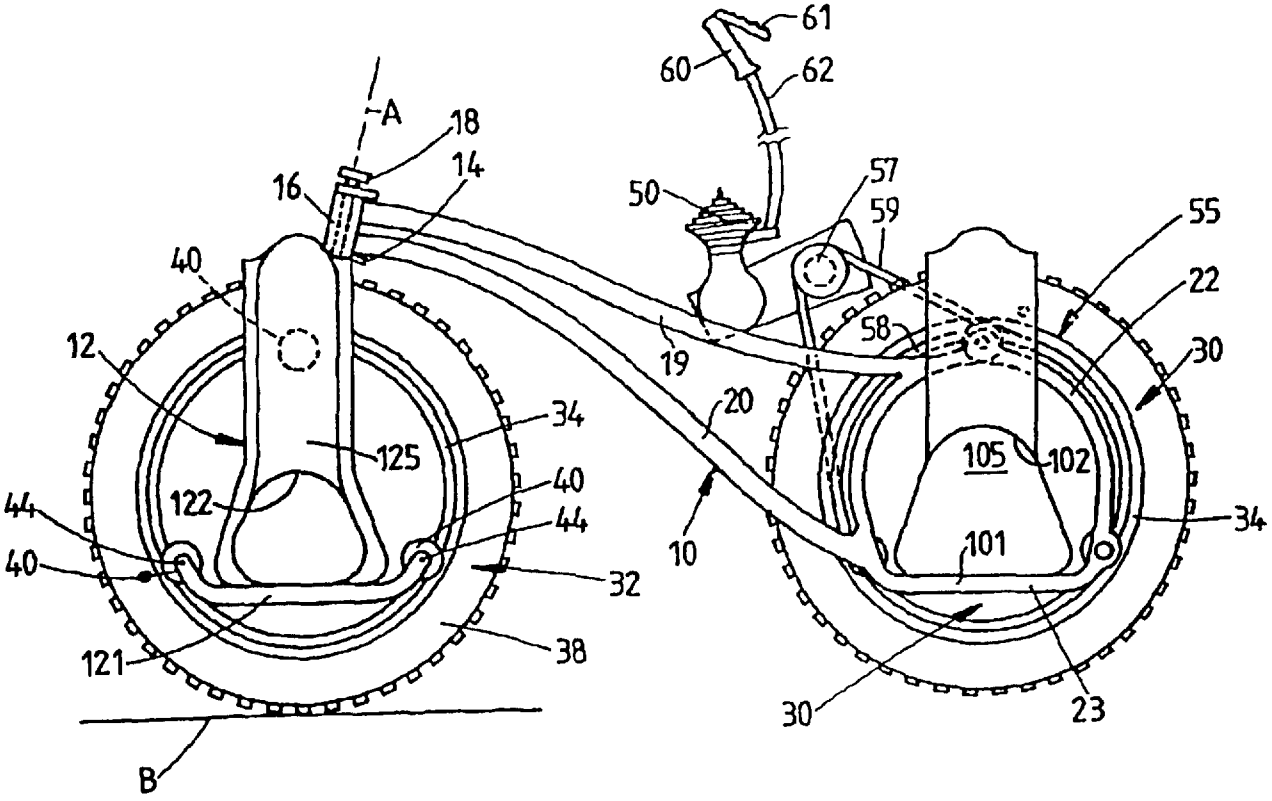
FIG. 1 is a schematic side view of a motorized skate vehicle according to a first embodiment of the invention.

The motorized skate vehicle illustrated in the figures is intended to be used in a similar way as a motorized skate board by a person standing on it hands-free but has distinctive advantages which shall become clear from the following description. The vehicle illustrated in FIGS. 1 and 2 comprises a frame structure having a rear frame part 10 and a front frame part 12. The front frame part 12 is pivotally connected to the rear frame part 10 to allow for limited pivotal movement along a substantially vertical pivot axis A with respect to the horizontal plane B.

The front frame part 12 is provided at its upper end with two connection plates 14 arranged parallel to one another and extending substantially horizontally, in between which a short connection tube 16 of the rear frame part 10 is inserted and rotationally held in place by a bolt 18 passing through respective bores in the connection plates 14 and the axial bore of the connection tube 16. The bolt 18 is secured against axial movement within the connection tube 16 to provide for a hinge like arrangement.

The front frame part 12 has at a lower location a horizontally extending foot platform 121 extending transversely to the longitudinal axis C and roughly contoured like an oversize shoe sole. The foot platform 121 is formed and designed in such a way to have low weight and withstand considerable bending movements experienced in use of the vehicle. The front frame part 12 further has a shin-guard 125 extending perpendicularly upwardly from the foot platform 121 and integrally moulded or formed therewith in the form of a foot insert 122 i.e. like a boot open to the rear part thereof. The connection plates 14 mentioned above are integrally formed with or fixed to the upper part of the shin-guard 125.

The rear frame part 10 consists of two slightly curved tubular members 19 and 20, the front ends which of are secured to the connection tube 16 which extends almost perpendicular thereto. From the connection tube 16 rearwards, the tubular members 19, 20 extend slightly divergently to one another in the vertical direction. Viewed from above, the members 19, 20 are curved with respect to longitudinal axis C so that the front portions of the tubular members 19, 20 coincide with the axis C and the rear portions are offset relative thereto.

The rear ends of the tubular members 19, 20 lead into or are connected with a generally circular tubular section 22 which has a straight or flattened horizontal part 23 on the lower part thereof. As can be seen from FIG. 2, the circular tubular section 22 has no curvature in the vertical plane and is arranged parallel to the longitudinal axis C.

The rear frame part 10 also has a foot platform 101 shaped similarly to the one previously described, also being provided with a shin-guard 105 integrally formed therewith or attached thereto. The foot platform 101 is securely fixed to the straight part 23 of the circular tubular section 22, while the shin-guard plate 105 is securely fixed to a curved part of section 22 opposite the straight section 23, by any suitable means, such as fastening screws or bolts. The rear frame tubular members 19, 20 and section 22 and the attached foot platform 101 and shin-guard 105 are designed to provide efficient lateral, vertical, horizontal and diagonal rigidity with a residual amount of flexibility to enhance stability of the whole rear frame part 10 itself. The same applies to the front frame part 12.

The frame parts 10, 12 can for example be made of aluminum or a light metal alloy or of fibre reinforced plastics, i.e. carbon reinforced phenol or the like, or a combination thereof. This means, also for example, that the rear frame part 10 can be made of tubular aluminum struts welded together while the foot plate with integral shin-guard plate and the whole front frame part 12 can be integrally moulded using an adequate plastic material which can be reinforced.

The skate vehicle has two ring-shaped main wheels 30, 32 which are arranged in-line along the longitudinal axis C, for rotation about axes transverse to the axis C.

The ring-shaped wheels 30, 32 each have, in this embodiment of the invention, a ring-shaped rim 34 with an inner circumferential surface 36 which has a profile with an inwardly protruding portion 36*a*. The outer circumferential surface is formed to receive and securely accommodate an inflatable rubber tire 38, preferably with a tread profile adapted for rough terrain use. In an embodiment not illustrated, the ring-shaped wheels can be formed integrally in one part using a suitable abrasive resistant rigid or semi-elastic plastic material. The rim 34 can be for example be made of aluminum or another light metal alloy or of reinforced plastic, i.e. PA66.

Figure 2:
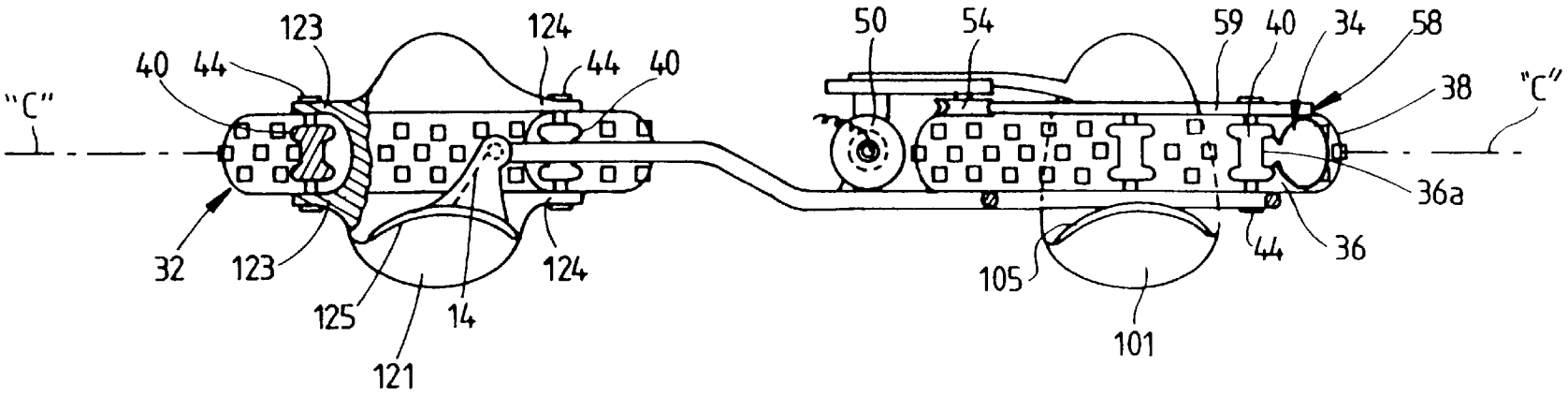
FIG. 2 is a schematical view from the top, partly sectioned, of the skate vehicle shown in FIG. 1.

The front as well as the rear ring-shaped wheels 30, 32 are each rotatably carried, on the front frame part 12 and rear frame part 10 respectively, by means of sets of three support rollers 40, the rollers of each set being arranged on the corners of an imaginary equilateral triangle and which engage with the inner circumferential surface 36 of the respective ring-shaped wheel 30, 32. The outer circumferential surface 42 of each roller has a profile which correlates to the inner circumferential surface 36 of the rim 34, that is, it comprises inclined lateral side portions in between which a peripheral recess is formed to receive the protruding portion of the rim 36. This is shown in FIG. 2. This arrangement provides for a secure and friction reduced engagement of the rollers 40 in the rim 34 and allows the wheel-roller arrangement to withstand considerable lateral forces without the ring-shaped wheels 30, 32 derailing from the respective three support rollers 40.

The support rollers 40 are each rotatably carried by bearing axles or bolts 44 which are held stationary on the respective frame parts 10, 12. The front frame part 12 has front and rear forked extensions 123, 124 of the foot platform 121, in between which the respective support rollers 40 are borne by means of respective bearing axles 44 axially extending between opposed portions of the respective extensions 123, 124 as can be seen in the cut out section in FIG. 2.

Although the extensions 123, 124 slightly curve upwardly, the plane in which the foot platform 121 extends is still substantially the same horizontal plane as that in which the two mentioned support rollers 40 are arranged. The bearing axle or bolt 44 for the third support roller 40 of the front frame part 12 is suspended within a bracket like support (not shown) which extends transversely of the vehicle into the front ring-shaped wheel 32 and is attached to or integrally formed with the shin-guard 125.

In a similar way, three support rollers 40 are attached to the rear frame part 10 on the circular tubular section 22, whereby two of the support rollers 40 are arranged in a horizontal plane on the front and rearward end of the straight tubular section 23 and the third support roller 40 on the circular upper section. The circular tubular section 22 is reinforced in the area bearing the respective bearing axles or bolts 44 for the support rollers 40 to prevent damage of the bearing bores due to wear.

As can be seen from the Figures, the foot platforms 101 and 121 extend through the respective front and rear wheels 30, 32 transversely to the median planes of the wheels in such a manner that the shin-guards extend upwardly, in generally parallel disposition on sides of each of the wheels 30, 32, as the same side of the vehicle, with sufficient clearance to allow interference free rotation of the wheels 30, 32, while the boot-like covers 102,122 of the foot platforms 101, 121 pass through the wheels 30, 32 and protrude laterally therefrom. The foot platforms 101 and 121 are positioned between the respective lower two support rollers 40, which lower support rollers are in each case arranged at front and rear ends. The foot platforms are so disposed with respect to the longitudinal axis C so as to provide optimal weight distribution on respective support rollers 40 to minimize bending moments along the C axis and perpendicularly thereto.

The skate vehicle is further provided with a drive engine 50 of for example combustion or electrical type which is securely mounted on the rear frame part 10 and arranged in such a way as to reduce turning moments with respect to the longitudinal axis C due to asymmetrical weight distribution.

The drive engine 50 may be similar to those used on home mowing machines. Drive engine 50 drives (either directly or by an intermediate reduction gear) the rear wheel 30 through suitable transmission means 55, which in the embodiment shown consist of a drive pulley 57 on the drive engine side, a drive ring 58 which has the same diameter as the rim 34 of the rear wheel 30 and is fixed to the rim so as to rotate with the wheel 34. An endless drive belt 59 running over the pulley 57 and ring 58 is provided to transmit torque from the drive engine 50 to the rear wheel 30. The engagement between endless drive belt 59 and pulley 57 and ring 58 can be of simple frictional nature, or can be accomplished using a cogged endless belt with a correspondingly cogged pulley and ring.

In an embodiment not shown in the Figures, the torque transmission can alternatively be accomplished using a friction roller directly connected to the drive engine or the reduction gear and engaging with the rear wheel, preferably into the inner circumferential surface of the rim in a similar manner to the engagement described with relation to the support rollers and wheels above. To operate the drive engine 50 and regulate its power output, there is provided a multipurpose handle 60 which in the embodiment shown has a swivel lever 61 to regulate the revolutions of the drive engine. The multipurpose handle 60 is connected to the drive engine 50 by means of a suitable flexible connection line 62. The skate vehicle is also provided with a small petrol tank or batteries for the drive engine 50, which are not shown. A brake of known type, for example like the ones used for bicycles, is incorporated into the skate vehicle to brake one or both wheels 30, 32 and can be operated from the multipurpose handle 60.

The flexible connection line 62 may have an outer tubular cover containing an elongate lengthwise slidable flexible member which is moved lengthwise in the cover by actuation of a pivotal lever 61 on handle 60 so as to effect movement of, for example, a throttle for the vehicle motor. In the case of an electric powered vehicle, the movement may control circuitry for the motor. In either event, the line 62 may alternatively be arranged for control of the motor by electric signals conveyed by one or more wires forming the line 62 or by conveying pneumatic or hydraulic pressure signals down the line, the line in such case being formed as a flexible duct.

Referring to FIGS. 3 to 6, a wheeled vehicle 200 is shown which operates similarly to the motorised skate vehicle described hereinabove, although employing a slightly different construction. Front and rear ring wheels 206, 204 are provided, each having an open central portion circumferentially defined by a wheel bearing rim 208. The outer circumferential portion of each ring wheel 206, 204 is advantageously provided with an all terrain tire with suitable tread, such as an inflatable rubber tire. In practice the ring wheels may be constructed from, for example, wheels adapted for use on small motorcycles, having the hub and spoke portions removed leaving the inner central portion defined by the wheel bearing rim 208 open. Such a wheel may have an external diameter, for example, of the order of 40 cm.

The main structure of the vehicle 200 is provided by front and rear chassis portions 220, 218, a lower chassis portion 222, and a chassis bar 250. The rear chassis 218 is integrally formed with the lower chassis 222, and is constructed from a moulded resiliently rigid material such as glass reinforced plastic. The rear chassis 218 is moulded so as to substantially cover one side of the rear ring wheel 204 and a portion of the top thereof in the form of a mudguard. A portion of the rear chassis 218 is recessed so as to extend through the open central portion of the rear wheel 204 to form a rear foot cover 216, the bottom of which comprises a rear foot platform which also extends laterally in a direction opposed to the foot recess in a semicircular shape. The laterally extending rear foot platform 254 is also integrally formed with the lower chassis 222, which comprises an extension of the rear foot platform 254, extending centrally between the front and rear ring wheels 206, 204 to provide a mounting surface for an engine 236.

The front chassis 220 is constructed in similar manner to the rear chassis 218, having a front foot platform 256 extending laterally from the plane of the front wheel 206, and extending through the open central portion thereof in the form of a front foot cover 217.

The front and rear ring wheels 206, 204 are rotatably mounted on the front and rear chassis portions 220, 218 respectively by means of bearing rollers 210. As seen best in FIG. 3 with respect to the rear ring wheel 204 and rear chassis 218, four bearing rollers 210 are provided at spaced locations around the inner circumference of the wheel 204. The bearing rollers 210 are fixed with respect to the frame of the vehicle and each bear against the wheel bearing rim 208 so that the wheel may undergo rotational movement with respect to the frame. A roller frame 212 is mounted to the rear chassis 218 underneath the rear foot platform 254 and foot cover 216, and is generally Y-shaped with bearing rollers 210*b*, 210*c* and 210*d* rotatably mounted at the ends of the frame arms. Bearing rollers 210*b* and 210*c* are positioned to either side of the rear foot cover 216 which extends through the rear ring wheel 204, and bearing roller 210*d* bears against the inner circumference of the rear wheel 204 directly underneath the rear foot platform 254. An upper bearing roller 210*a* is provided directly above the rear foot cover 216 and mounted on the upper portion of the rear chassis 218. Further support for the upper bearing roller 210*a* may be provided by an upper roller support 214 extending from the top of the rear foot cover 216. In order to enable the wheels to withstand lateral forces without becoming disengaged from the bearing rollers 210, the bearing rollers are each provided with a central circumferential groove which cooperates with a ridge provided on the inner circumference of the wheel bearing rim 208 of the wheels 204, 206. This construction enables lateral forces applied to a wheel 204, 206 to be transferred through the inner circumferential ridge of the wheel to the circumferential ridges defining the central grooves of the bearing rollers 210, and thence to the front or rear chassis 220, 218.

The wheel vehicle 200 further comprises an engine 236 mounted in line between the front and rear ring wheels 206, 204 on the lower chassis 222. The engine preferably comprises a single or multicylinder petrol fuel engine such as the type frequently utilized in motorized gardening appliances, and is advantageously of the air cooled variety. The engine 236 is arranged with a rotary drive shaft having an axis of rotation parallel to the axis of the rear ring wheel 204. An engine drive sprocket 238 is coupled to the engine drive shaft, and bears a gear chain 240 to drive a gear sprocket 242. The gear sprocket 242 is rotatably mounted between the rear ring wheel 204 and engine drive sprocket 238 by means of a mounting plate coupled between a forward lower portion of the rear chassis 218 and the lower chassis 222. A further sprocket (not shown) is coaxially and rotatably mounted with the gear sprocket 242, which is arranged to deliver torque to the rear ring wheel 204 by means of a drive chain 246. For this purpose, the rear ring wheel 204 is provided with a wheel sprocket 248 mounted to a side of the rear wheel 204 adjacent the wheel bearing rim 208 and coaxial therewith. In order to provide the necessary gearing reduction from the engine 236 to the rear wheel 204, the size or number of gear teeth provided on the gear sprocket 242 is greater than that of the engine drive sprocket 238, and similarly the wheel sprocket 248 is of a significantly greater size than the further sprocket (not shown) from which it is driven. In use, the engine 236 may be controlled by means of a control handle 237 which incorporates a throttle control lever 239 coupled to the throttle mechanism of the engine 236 by way of a flexible control cable 235. A braking mechanism may also be provided on the front and/or rear ring wheel 206, 204, with a corresponding brake actuating mechanism on the control handle 237, however in the present embodiment it has been found that the engine 236 provides sufficient braking torque whilst the throttle is fully closed.

Figure 3:
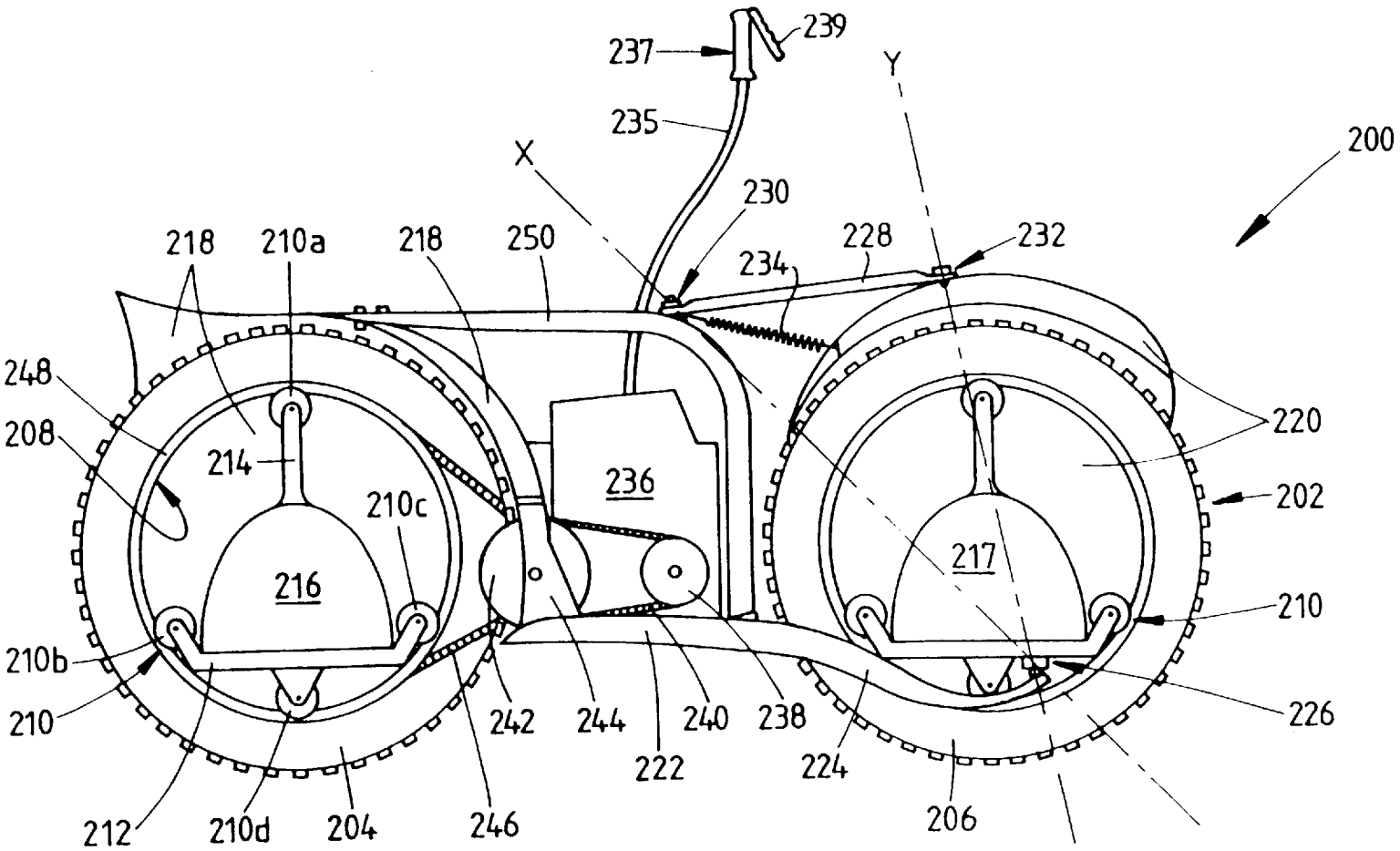
FIGS. 3 and 4 are opposed side views of a wheeled vehicle according to a second embodiment of the invention.
Figure 5:
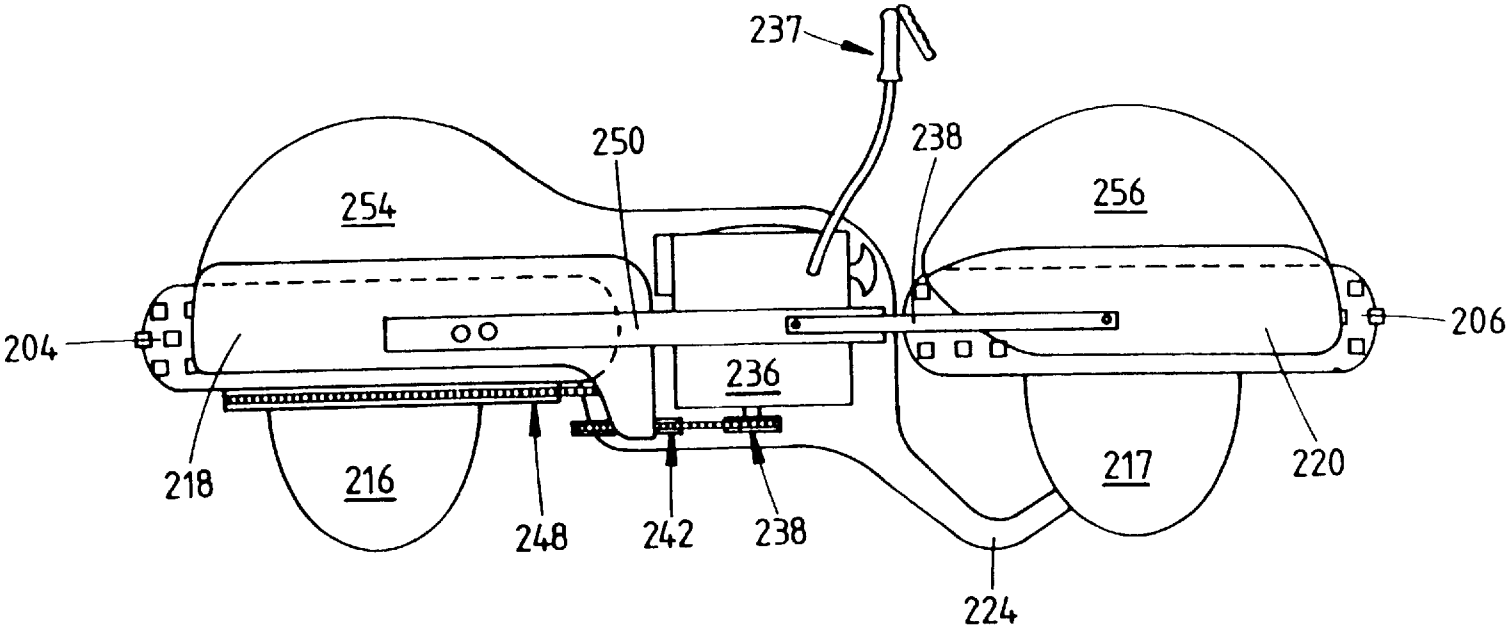
FIGS. 5 and 6 are top and bottom views respectively of the wheeled vehicle of FIGS. 3 and 4 and FIG. 7 is a side view of an alternative embodiment of the invention having a ski or skid member in place of one wheel.
Figure 6:
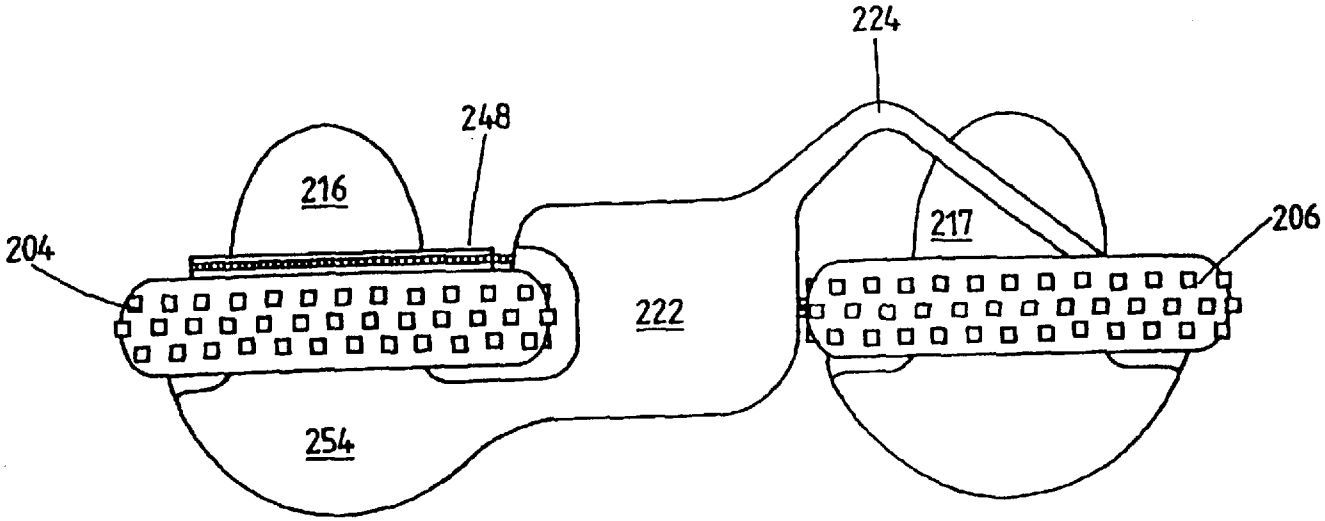

For increased structural stability of the rear chassis 218 and lower chassis 222, and to provide means to couple the front chassis 220 thereto, a chassis bar 250 is provided, coupled between an upper portion of the rear chassis 218 and a front portion of the lower chassis 222, passing over and in front of the engine 236. The front chassis 220 and thence the front ring wheel 206 are coupled to the vehicle 200 by means of a pivot arm 224 and steering linkage bar 228. As best seen in FIGS. 5 and 6, the pivot arm 224 is an angled member which angles laterally forward from a front edge of the lower chassis 222 to a fixed elbow joint from where it angles inwardly to a first pivotal connection in the form of lower steering pivot 226 connecting the pivot arm 224 with the front roller frame 212. The front chassis is also coupled to the chassis bar 250 by way of the steering linkage bar 228 which is pivotally connected to the. A steering bias spring 234 also couples the front chassis 220 to the chassis bar 250 at the rear upper steering pivot 230, the steering bias spring's connection to the front chassis 220 being rearward of the front upper steering pivot 232. The lower steering pivot 226 is advantageously pivotable in more than one dimension, such as a ball joint, which enables the front chassis 220, front wheel 206 and steering linkage bar 228 to pivot at both the front and rear upper steering pivots 232, 230. Referring to FIG. 3, this allows the front ring wheel 206 to rotate about an axis anywhere between axis X and Y passing through the lower steering pivot 226 and the rear and front upper steering pivots 230, 232 respectively. The lower steering pivot 226 is positioned on the front roller frame 212 forwardly of the axis of rotation of the front ring wheel 206, the front upper steering pivot 232 is positioned slightly to the rear of the axis of rotation, whilst the rear upper steering pivot 230, being on the chassis bar 250, is far to the rear of the front wheel's rotational axis. Furthermore, since the steering bias spring 234 is coupled to the front chassis 220 at a point closer to the rear upper steering pivot 230 than the front upper steering pivot 232, the front chassis 220 is biased against rotation about the front upper steering pivot 232 by the resilient action of the spring 234. Such an arrangement of pivots 230, 232, 226 and bias spring 234 creates a steering mechanism which is both stable at high speed and manoeuvrable at low speed, due to the adjustable pivot axis and spring bias. The laterally projecting fixed elbow joint of the pivot arm 224 allows space for the front wheel 206 and front chassis 220 to pivot within the bounds of the pivot arm 224. Whilst the construction illustrated is described with the lower steering pivot 226 positioned forwardly of the front wheel rotational axis, it should be noted that this is not necessary to achieve the benefits of the steering mechanism. The lower steering pivot 226 may in fact be altered in position along the front roller frame 212 so as to be positioned to the rear, aligned with, or forward of the front wheel axis of rotation depending upon desired steering characteristics. With the pivot 226 positioned forwardly on the roller frame 212 the vehicle tends towards understeer in handling characteristics, whilst with the pivot 226 positioned rearwardly oversteering characteristics can be achieved.

This steering mechanism differs significantly from that of a conventional wheeled vehicle wherein a head stem bracket is provided on the frame to pivotally constrain a shaft coupled to the front wheel and also to apparatus such as handlebars in the case of a bicycle or motorcycle. Firstly, since the majority of load placed on the vehicle is transferred efficiently to the front and rear ring wheels 204, 206, the steering mechanism is not required to transfer large amounts of load related forces between the front and rear chassis portions 220, 218. Furthermore, since the steering mechanism of the wheeled vehicle 200 is not constrained to be coupled to a central member of the front wheel 206, such as a central axle, a greater degree of flexibility in placement of the pivot points in the steering mechanism is afforded.

Figure 4:
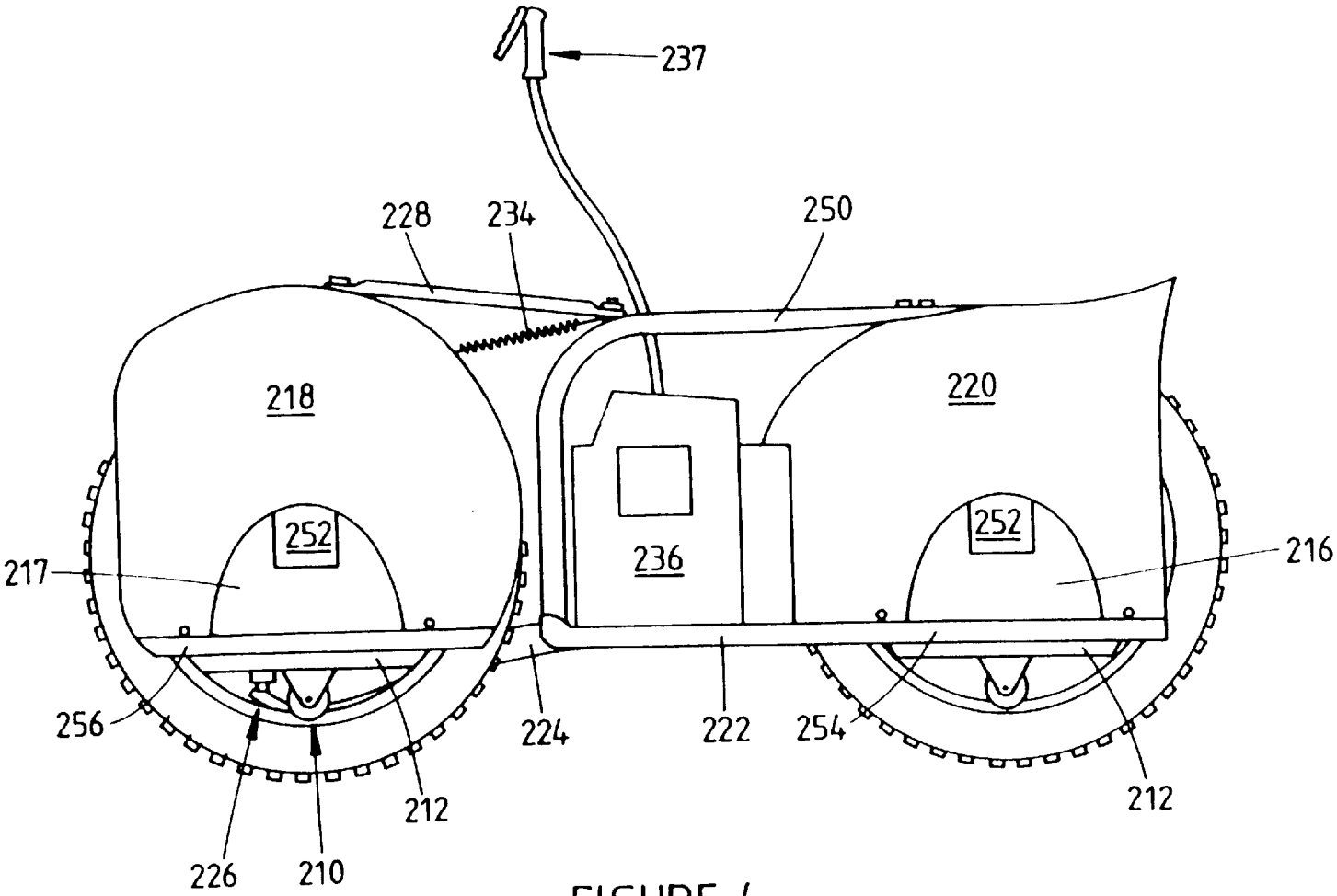

In use of the wheeled vehicle 200, the user stands on the vehicle facing in the direction of the view in FIG. 4, with left foot placed on the front foot platform 256 and right foot on the rear foot platform 254. The user's feet project through the front and rear ring wheels 206, 204 within the front and rear foot cover recesses 217, 216. The rider operates the vehicle by regulating the engine throttle by way of the control handle 237 grasped in one hand, and steers by leaning the vehicle from side to side. Steering of the vehicle at slower speeds may also be achieved by manipulating the front chassis 220 and front wheel 206 with the left foot, thereby steering the vehicle by manual rotation of the front ring wheel 206 about the steering pivots. The construction of the vehicle 200 in which the foot platforms 254, 256 project through the central portion of the ring wheels 204, 206 enables the vehicle to combine a low center of gravity with relatively large diameter wheels, whilst maintaining a relatively short wheel base. Enhanced stability is achieved by enabling the rider's weight to be transferred to the vehicle through the rider's feet placed directly above the points at which the vehicle wheels 204, 206 are in contact with the ground.

Figure 7:
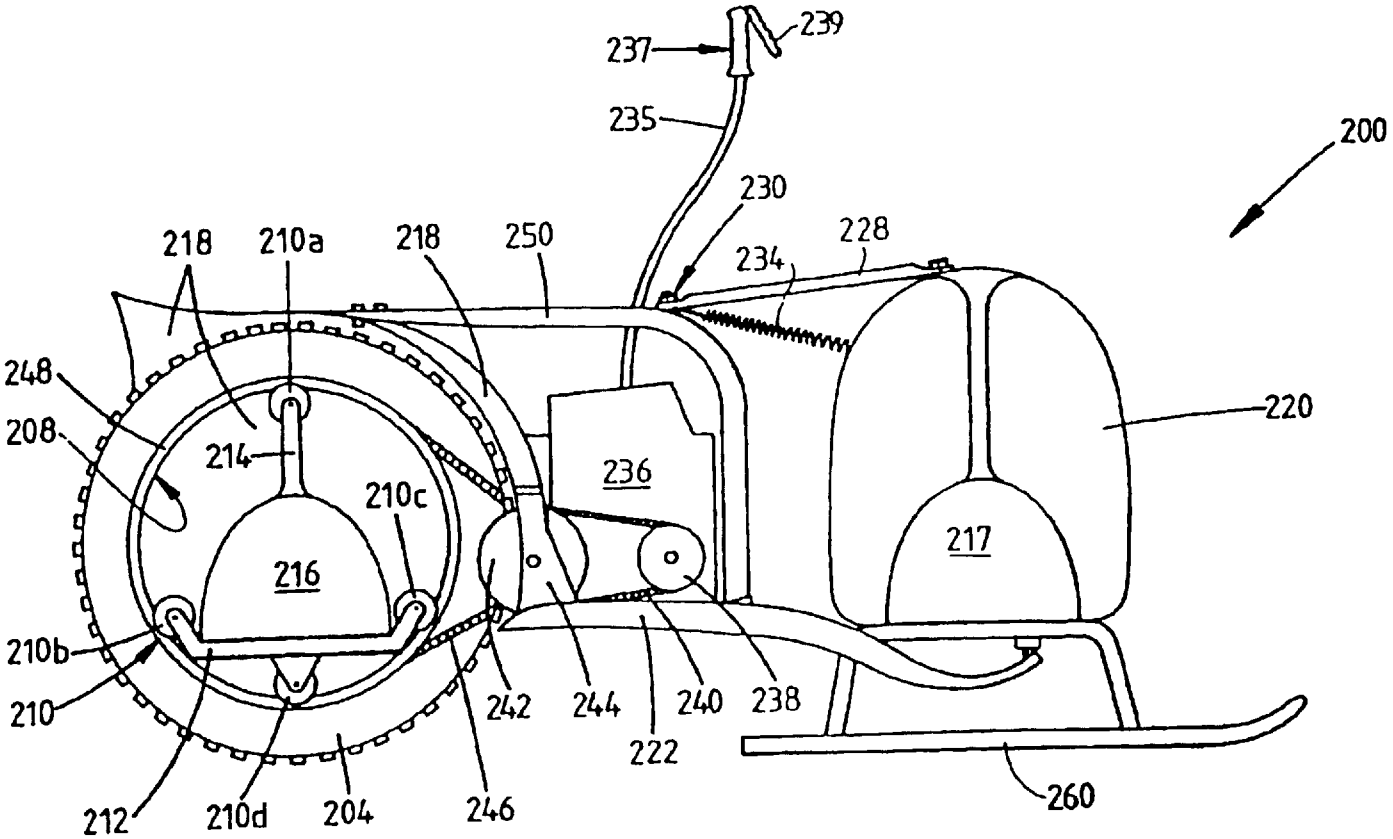

In summary, vehicle described has the advantage of a low center point of gravity due to the bearing arrangement of the ring wheels arranged in-line to one another and which are respectively rotatably carried at their inner circumferential surface by support rollers arranged around the inner circumference and which are rotatably held by the frame structure, so that two individual foot rests or platforms can be provided extending transversely of the vehicle through each of said ring wheels. This allows a person to "ride" the vehicle in a manner similar to a surfboard, that is with the person standing hands-free with his body facing laterally to the travel direction and balancing the vehicle by body movement and steering the same either by pivotal rotation of the front wheel with the front foot or in a conventional way by shifting body weight out of the center point of gravity. Handle bars may, however, be provided for added stability. Therefore, it is not strictly necessary to provide a two-part frame with a pivotally movable front wheel, and in another embodiment of the invention the frame can be constructed in one piece, therefore allowing for a variety of different designs of the actual frame configuration. Similarly, it is not strictly necessary to have tubular frame sections, a plate like integral body frame is also viable. In another embodiment shown in FIG. 7 the front wheel can be substituted by a ski or a skate like element, 260 so that the skate vehicle can also be used on snow. The larger diameter ring-wheels - when compared with those conventionally used with skateboards or scooters - allow the vehicle to be used on rough terrain, thus enabling a broader scope of use. Furthermore, although the embodiments of the invention described herein utilize rollers fixed to the frame to support the ring shaped wheels it is also envisaged that the frame could be provided with a circular hub which extends around a respective foot platform and defines an annular space between the hub and the inner circumferential surface of the corresponding wheel such that bearing rollers may be trapped between a hub and the inner circumferential surface of a wheel whereby the hubs themselves are fixed with respect to the frame whilst the bearing rollers are moveable within the annular space to allow rotation of the wheel without binding on the hub.

In a further embodiment, the frame of the vehicle is flexible in which case portions of the frame at the front and rear are interconnected by a resilient portion of the frame permitting a hinging action as between the front and rear portions generally about an upright axis. This facilitates a "walking" movement of the vehicle under control of the user. The resilience may be imparted by forming the frame, or at least the part joining the front and rear portions thereof, as an inflatable structure.

The foregoing detailed description of the invention has been put forward merely by way of example only, and is not intended to be limiting to the invention which is defined in the claims appended hereto.

What is claimed is:

1. A wheeled vehicle for carrying a person comprising a frame rotatably supporting two substantially in-line wheels, and foot support structures adapted to support the feet of a user, wherein said wheels are ring-shaped and the foot support structures are coupled to said frame and extend axially through respective said wheels so as to support respective feet of a user while the user's feet extend through the ring-shaped wheels.

2. A wheeled vehicle according to claim 1, including a motor mounted on said frame between the two wheels and coupled to rotatably drive one of said wheels.

3. A wheeled vehicle according to claim 2 wherein the motor is provided with throttle control means operable by the hand of a person standing on the foot support members.

4. A wheeled vehicle according to claim 1, wherein the frame is articulated between the two wheels to enable steering of the vehicle by pivotal movement of one wheel with respect to the other.

5. A wheeled vehicle according to claim 4 wherein the frame is articulated by means of a steering mechanism comprising a first pivotal connection between the frame and the structure rotatably supporting one of the wheels, and a linkage member comprising a second pivotal connection between the frame and the linkage member and a third pivotal connection between the vehicle and the linkage member and a third pivotal connection between the linkage member and said structure, the second and third pivotal connections being spaced from one another along a direction of travel of the vehicle, wherein, with respect to the direction of travel of the vehicle, the second and third pivotal connections are disposed above the rotational axis of said one wheel and the first pivotal connection is disposed below said rotational axis, such that said one wheel is pivotal with respect to the frame about a pivot axis which is variable between axes passing through the first pivotal connection and the second and third pivotal connections respectively.

6. A wheeled vehicle according to claim 4, wherein the articulated frame comprises a front chassis portion and a rear chassis portion which are coupled together by way of a lower pivot arm and an upper pivot arm.

7. A wheeled vehicle including:

a frame;

two substantially in-line ring-shaped wheels;

internal wheel support means coupled to the frame and bearing on internal rim portions of the wheels so as to rotatably couple the wheels to the frame; and a pair of foot support members coupled to the frame and extending through the ring-shaped wheels, the foot support members being adapted to support the feet of a user while respective feet of the user extend axially through respective ones of the ring-shaped wheels.

8. A wheeled vehicle according to claim 7, including a motor mounted on said frame between the two wheels and coupled to rotatably drive one of said wheels.

9. A wheeled vehicle according to claim 7, wherein the frame is articulated between the two wheels to enable steering of the vehicle, in use, by pivotal movement of one wheel with respect to the other.

10. A wheeled vehicle according to claim 9, wherein the articulated frame comprises a front chassis portion and a rear chassis portion which are coupled together by way of a lower pivot arm and an upper pivot arm.

11. A motorized vehicle comprising:

a frame to which a drive engine is mounted;

at least one wheel rotatably supported by said frame;

transmission means coupled between the drive engine and a said wheel for passing drive torque from said drive engine to said wheel;

foot support means coupled to said frame onto which a person can step and stand on during movement of the vehicle; and control means coupled to the drive engine, operable by a person standing on the foot support means to regulate the drive engine;

wherein said at least one wheel is ring-shaped and rotatably supported by at least three supporting rollers at different angular positions which engage with an inner circumferential surface of each said ring wheel, bearing axles of said supporting rollers being fixed to said frame, and wherein said foot support means comprises two foot platforms at least one of which extends axially through said wheel and is adapted to support a foot of a user whilst extending axially through said wheel.

12. A steering mechanism for coupling a wheel to a vehicle, comprising a first pivotal connection between the vehicle and structure rotatably supporting the wheel, and a linkage member comprising a second pivotal connection between the vehicle and the linkage member and a third pivotal connection between the linkage member and said structure, the second and third pivotal connections being spaced from one another along a direction of travel of the vehicle, wherein, with respect to the direction of travel of the vehicle, the second and third pivotal connections are disposed above the rotational axis of said one wheel and the first pivotal connection is disposed below said rotational axis, such that said one wheel is pivotal with respect to the frame about a pivot axis which is variable between axes passing through the first pivotal connection and the second and third pivotal connections respectively.

13. A wheeled vehicle for carrying a person, comprising:

a frame;

a ring-shaped wheel rotatably supported on said frame by a plurality of rollers mounted on said frame and which are arranged around the ring-shaped wheel to bear upon an inner circumferential surface thereof;

additional load bearing means coupled to the frame and adapted to, in conjunction with the wheel, carry the vehicle on a riding surface; and foot support members coupled to the frame, at least one of which extends through the ring-shaped wheel and is adapted to support a foot of a user while the user's foot extends axially through the ring-shaped wheel and the wheel and additional load bearing means support the vehicle on the riding surface.

14. A wheeled vehicle according to claim 13 wherein the additional load bearing means comprises a ring-shaped wheel rotatably supported on the frame by a plurality of rollers, wherein the vehicle includes two said ring-shaped wheels disposed substantially in-line.

15. A wheeled vehicle according to claim 13, wherein the additional load bearing means comprises one of a ski and skid member disposed substantially in line with the wheel.

16. A wheeled vehicle according to claim 14, wherein said foot support members comprise a pair of platform structures, each coupled to said frame and extending axially through a respective one of said wheels, the wheels and platform structures defining respective recesses dimensioned for portions of the user's feet to extend through the ring-shaped wheels to allow a person to stand on the vehicle.

17. A wheeled vehicle according to claim 13, including a motor mounted on said frame between the wheel and the additional load bearing means and coupled to rotatably drive said wheel.

18. A wheeled vehicle according to claim 14, wherein the frame is articulated between the two wheels to enable steering of the vehicle, in use, by pivotal movement of one wheel with respect to the other.

19. A wheeled vehicle according to claim 18, wherein the articulated frame comprises a front chassis portion and a rear chassis portion which are coupled together by way of a lower pivot arm and an upper pivot arm. chassis bar 250 by means of a rear upper steering pivot 230 forming a second pivotal connection, and to the front chassis 220 by means of a front upper steering pivot 232 forming a third pivotal connection.

* * * * *

UNITED STATES PATENT AND TRADEMARK OFFICE

CERTIFICATE OF CORRECTION

PATENT NO. : 5,826,674

DATED : October 27, 1998

INVENTOR(S) : Grant Taylor

It is certified that error appears in the above-identified patent and that said Letters Patent is hereby corrected as shown below:

In Claim 19, Column 12, Line 26, please delete all text after "an upper pivot arm."

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*